US008899320B2

(12) United States Patent
Le

(10) Patent No.: US 8,899,320 B2
(45) Date of Patent: Dec. 2, 2014

(54) WELL PERFORATING WITH DETERMINATION OF WELL CHARACTERISTICS

(75) Inventor: Cam Le, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 441 days.

(21) Appl. No.: 13/314,853

(22) Filed: Dec. 8, 2011

(65) Prior Publication Data

US 2012/0152542 A1 Jun. 21, 2012

(30) Foreign Application Priority Data

Dec. 17, 2010 (WO) ..... PCT/US2010/006110

(51) Int. Cl.
*E21B 49/04* (2006.01)
*E21B 43/11* (2006.01)
*E21B 47/06* (2012.01)

(52) U.S. Cl.
CPC ..... *E21B 43/11* (2013.01); *E21B 47/06* (2013.01)
USPC ..... 166/250.07; 166/250.1

(58) Field of Classification Search
CPC ..... E21B 47/06; E21B 47/065; E21B 43/116; E21B 43/263
USPC ..... 166/250.07, 250.1; 73/152.22, 152.12, 73/152.33, 152.51
See application file for complete search history.

(56) References Cited

U.S. PATENT DOCUMENTS

| | | | |
|---|---|---|---|
| 472,342 | A | 4/1892 | Draudt |
| 1,073,850 | A | 9/1913 | Greer |
| 2,440,452 | A | 4/1948 | Smith |
| 2,833,213 | A | 5/1958 | Udry |
| 2,980,017 | A | 4/1961 | Castel |
| 3,057,296 | A | 10/1962 | Silverman |
| 3,128,825 | A | 4/1964 | Blagg |
| 3,151,891 | A | 10/1964 | Sanders |
| 3,208,378 | A | 9/1965 | Boop |
| 3,216,751 | A | 11/1965 | Mott |
| 3,381,983 | A | 5/1968 | Hanes |
| 3,414,071 | A | 12/1968 | Alberts |

(Continued)

FOREIGN PATENT DOCUMENTS

| | | | |
|---|---|---|---|
| GB | 2406870 | A | 4/2005 |
| WO | 2004076813 | A1 | 9/2004 |
| WO | 2004099564 | A2 | 11/2004 |
| WO | 2007056121 | A1 | 5/2007 |

OTHER PUBLICATIONS

Office Action issued Mar. 12, 2014 for U.S. Appl. No. 13/304,075, 17 pages.

(Continued)

*Primary Examiner* — Cathleen Hutchins
(74) *Attorney, Agent, or Firm* — Smith IP Services, P.C.

(57) ABSTRACT

A formation testing method can include interconnecting multiple pressure sensors and multiple perforating guns in a perforating string, the pressure sensors being longitudinally spaced apart along the perforating string, firing the perforating guns and the pressure sensors measuring pressure variations in a wellbore after firing the perforating guns. Another formation testing method can include interconnecting multiple pressure sensors and multiple perforating guns in a perforating string, firing the perforating guns, thereby perforating a wellbore at multiple formation intervals, each of the pressure sensors being positioned proximate a corresponding one of the formation intervals, and each pressure sensor measuring pressure variations in the wellbore proximate the corresponding interval after firing the perforating guns.

24 Claims, 8 Drawing Sheets

(56) References Cited

U.S. PATENT DOCUMENTS

| | | | | |
|---|---|---|---|---|
| 3,687,074 | A | 8/1972 | Andrews et al. | |
| 3,923,105 | A | 12/1975 | Lands, Jr. | |
| 3,923,106 | A | 12/1975 | Bosse-Platiere | |
| 3,923,107 | A | 12/1975 | Dillard | |
| 4,319,526 | A | 3/1982 | DerMott | |
| 4,410,051 | A | 10/1983 | Daniel et al. | |
| 4,612,992 | A | 9/1986 | Vann et al. | |
| 4,619,333 | A | 10/1986 | George | |
| 4,637,478 | A | 1/1987 | George | |
| 4,685,708 | A | 8/1987 | Conner et al. | |
| 4,693,317 | A | 9/1987 | Edwards et al. | |
| 4,694,878 | A | 9/1987 | Gambertoglio | |
| 4,817,710 | A | 4/1989 | Edwards et al. | |
| 4,830,120 | A | 5/1989 | Stout | |
| 4,884,829 | A | 12/1989 | Funk et al. | |
| 4,901,802 | A | 2/1990 | George et al. | |
| 5,027,708 | A | 7/1991 | Gonzalez et al. | |
| 5,103,912 | A | 4/1992 | Flint | |
| 5,107,927 | A | 4/1992 | Whiteley et al. | |
| 5,131,470 | A | 7/1992 | Miszewski | |
| 5,161,616 | A | 11/1992 | Colla | |
| 5,287,924 | A | 2/1994 | Burleson et al. | |
| 5,341,880 | A | 8/1994 | Thorstensen et al. | |
| 5,343,963 | A | 9/1994 | Bouldin et al. | |
| 5,366,013 | A | 11/1994 | Edwards et al. | |
| 5,490,694 | A | 2/1996 | Shumway | |
| 5,529,127 | A | 6/1996 | Burleson et al. | |
| 5,598,894 | A | 2/1997 | Burleson et al. | |
| 5,603,379 | A | 2/1997 | Henke et al. | |
| 5,662,166 | A | 9/1997 | Shammai | |
| 5,667,023 | A | 9/1997 | Harrell et al. | |
| 5,671,955 | A | 9/1997 | Shumway | |
| 5,823,266 | A | 10/1998 | Burleson et al. | |
| 5,868,200 | A | 2/1999 | Bryant et al. | |
| 5,957,209 | A | 9/1999 | Burleson et al. | |
| 5,964,294 | A | 10/1999 | Edwards et al. | |
| 5,992,523 | A | 11/1999 | Burleson et al. | |
| 6,098,716 | A | 8/2000 | Hromas et al. | |
| 6,173,779 | B1 | 1/2001 | Smith | |
| 6,283,214 | B1 | 9/2001 | Guinot et al. | |
| 6,397,752 | B1 | 6/2002 | Yang et al. | |
| 6,543,538 | B2 | 4/2003 | Tolman et al. | |
| 6,595,290 | B2 | 7/2003 | George et al. | |
| 6,672,405 | B2 | 1/2004 | Tolman et al. | |
| 6,679,327 | B2 | 1/2004 | Sloan et al. | |
| 6,684,954 | B2 | 2/2004 | George | |
| 6,708,761 | B2 | 3/2004 | George et al. | |
| 6,752,207 | B2 | 6/2004 | Danos et al. | |
| 7,000,699 | B2 | 2/2006 | Yang et al. | |
| 7,114,564 | B2 | 10/2006 | Parrott et al. | |
| 7,195,066 | B2 | 3/2007 | Sukup et al. | |
| 7,387,162 | B2 | 6/2008 | Mooney, Jr. et al. | |
| 7,393,019 | B2 | 7/2008 | Taga et al. | |
| 7,533,722 | B2 | 5/2009 | George et al. | |
| 7,600,568 | B2 | 10/2009 | Ross et al. | |
| 7,699,356 | B2 | 4/2010 | Bucher et al. | |
| 7,721,820 | B2 | 5/2010 | Hill et al. | |
| 7,722,089 | B2 | 5/2010 | Nauer | |
| 7,762,331 | B2 | 7/2010 | Goodman et al. | |
| 7,806,035 | B2 | 10/2010 | Kaiser et al. | |
| 7,954,860 | B2 | 6/2011 | Suzuki | |
| 8,126,646 | B2 | 2/2012 | Grove et al. | |
| 8,136,608 | B2 | 3/2012 | Goodman | |
| 2002/0088620 | A1* | 7/2002 | Lerche et al. | 166/297 |
| 2002/0121134 | A1 | 9/2002 | Sweetland et al. | |
| 2002/0189809 | A1 | 12/2002 | Nguyen et al. | |
| 2003/0000699 | A1 | 1/2003 | Hailey, Jr. | |
| 2003/0062169 | A1 | 4/2003 | Marshall | |
| 2003/0089497 | A1 | 5/2003 | George et al. | |
| 2004/0104029 | A1 | 6/2004 | Martin | |
| 2004/0140090 | A1 | 7/2004 | Mason et al. | |
| 2006/0048940 | A1 | 3/2006 | Hromas et al. | |
| 2007/0101808 | A1 | 5/2007 | Irani et al. | |
| 2007/0162235 | A1 | 7/2007 | Zhan et al. | |
| 2007/0193740 | A1* | 8/2007 | Quint | 166/250.07 |
| 2007/0193749 | A1 | 8/2007 | Folk | |
| 2008/0041597 | A1 | 2/2008 | Fisher et al. | |
| 2008/0149338 | A1 | 6/2008 | Goodman et al. | |
| 2008/0202325 | A1 | 8/2008 | Bertoja et al. | |
| 2009/0151589 | A1 | 6/2009 | Henderson et al. | |
| 2009/0159284 | A1 | 6/2009 | Goodman | |
| 2009/0168606 | A1 | 7/2009 | Lerche et al. | |
| 2009/0182541 | A1 | 7/2009 | Crick et al. | |
| 2009/0223400 | A1 | 9/2009 | Hill et al. | |
| 2009/0241658 | A1 | 10/2009 | Irani et al. | |
| 2009/0272529 | A1 | 11/2009 | Crawford | |
| 2009/0276156 | A1 | 11/2009 | Kragas et al. | |
| 2009/0294122 | A1 | 12/2009 | Hansen et al. | |
| 2010/0000789 | A1 | 1/2010 | Barton et al. | |
| 2010/0011943 | A1 | 1/2010 | Quinn et al. | |
| 2010/0051265 | A1 | 3/2010 | Hurst et al. | |
| 2010/0085210 | A1 | 4/2010 | Bonavides et al. | |
| 2010/0132939 | A1 | 6/2010 | Rodgers | |
| 2010/0133004 | A1 | 6/2010 | Burleson et al. | |
| 2010/0147519 | A1 | 6/2010 | Goodman | |
| 2010/0230105 | A1 | 9/2010 | Vaynshteyn | |
| 2012/0085539 | A1 | 4/2012 | Tonnessen et al. | |
| 2012/0152614 | A1 | 6/2012 | Rodgers et al. | |
| 2012/0152615 | A1 | 6/2012 | Rodgers et al. | |
| 2012/0152616 | A1 | 6/2012 | Rodgers et al. | |
| 2012/0158388 | A1 | 6/2012 | Rodgers et al. | |

OTHER PUBLICATIONS

Office Action issued Mar. 21, 2014 for U.S. Appl. No. 14/104,130, 19 pages.

IES, Scott A. Ager; "IES Housing and High Shock Considerations", informational presentation, received Sep. 1, 2010, 18 pages.

IES, Scott A. Ager; Analog Recorder Test Example, informational letter, dated Sep. 1, 2010, 1 page.

IES, Scott A. Ager; "Series 300 Gauge", product information, dated Sep. 1, 2010, 1 page.

IES, Scott A. Ager; "IES Introduction", Company introduction presentation, received Sep. 1, 2010, 23 pages.

Petroleum Experts; "IPM: Engineering Software Development", product brochure, dated 2008, 27 pages.

International Search Report with Written Opinion issued Oct. 27, 2011 for PCT Patent Application No. PCT/US11/034690, 9 pages.

Kappa Engineering; "Petroleum Exploration and Product Software, Training and Consulting", product informational paper on v4.12B, dated Jan. 2010, 48 pages.

Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, received Jan. 28, 2010, 6 pages.

Mario Dobrilovic, Zvonimir Ester, Trpimir Kujundzic; "Measurements of Shock Wave Force in Shock Tube with Indirect Methods", Original scientific paper vol. 17, str. 55-60, dated 2005, 6 pages.

IES, Scott A. Ager; "Model 64 and 74 Buildup", product presentation, dated Oct. 17, 2006,57 pages.

A. Blakeborough et al.; "Novel Load Cell for Measuring Axial Forca, Shear Force, and Bending Movement in large-scale Structural Experiments", Informational paper, dated Mar. 23-Aug. 30, 2001, 8 pages.

Weibing Li et al.; "The Effect of Annular Multi-Point Initiation on the Formation and Penetration of an Explosively Formed Penetrator", Article in the International Journal of Impact Engineering, dated Aug. 27, 2009, 11 pages.

Sergio Murilo et al.; "Optimization and Automation of Modeling of Flow Perforated Oil Wells", Presentation for the Product Development Conference, dated 2004, 31 pages.

Frederic Bruyere et al.; "New Practices to Enhance Perforating Results", Oilfield Review, dated Autumn 2006, 18 pages.

John F. Schatz; "Pert Breakdown, Fracturing, and Cleanup in PulsFrac", informational brochure, dated May 2, 2007, 6 pages.

M. A. Proett et al.; "Productivity Optimization of Oil Wells Using a New 3D Finite-Element Wellbore Inflow Model and Artificial Neutral Network", conference paper, dated 2004, 17 pages.

(56) References Cited

OTHER PUBLICATIONS

John F. Schatz; "PulsFrac Summary Technical Description", informational brochure, dated 2003, 8 pages.
IES, Scott A. Ager; "IES Recorder Buildup", Company presentation, received Sep. 1, 2010, 59 pages.
IES, Scott A. Ager; "IES Sensor Discussion", received Sep. 1, 2010, 38 pages.
IES; "Series 300: High Shock, High Speed Pressure Gauge", product brochure, dated Feb. 1, 2012, 2 pages.
IES; "Series 200: High Shock, High Speed Pressure and Acceleration Gauge", product brochure, received Feb. 11, 2010, 2 pages.
Terje Rudshaug, et al.; "A toolbox for improved Reservoir Management", NETool, Force AWTC Seminar, Apr. 21-22, 2004, 29 pages.
Halliburton; "ShockPro Schockload Evaluation Service", Perforating Solutions pp. 5-125 to 5-126, dated 2007, 2 pages.
Halliburton; "ShockPro Schockload Evaluation Service", H03888, dated Jul. 2007, 2 pages.
Strain Gages; "Positioning Strain Gages to Monitor Bending, Axial, Shear, and Torsional Loads", pp. E-5 to E-6, dated 2012, 2 pages.
B. Grove, et al.; "Explosion-Induced Damage to Oilwell Perforating Gun Carriers", Structures Under Shock and Impact IX, vol. 87, ISSN 1743-3509, SU060171, dated 2006, 12 pages.
WEM; "Well Evaluation Model", product brochure, received Mar. 2, 2010, 2 pages.
Endevco; "Problems in High-Shock Measurement", Meggitt brochure TP308, dated Jul. 2007, 9 pages.
Office Action issued Jun. 29, 2012 for U.S. Appl. No. 13/325,866, 30 pages.
Australian Examination Report issued Sep. 21, 2012 for AU Patent Application No. 2010365400, 3 pages.
Office Action issued Oct. 23, 2012 for U.S. Appl. No. 13/325,866, 35 pages.
Office Action issued Apr. 21, 2011 for U.S. Appl. No. 13/008,075, 9 pages.
Office Action issued May 4, 2011 for U.S. Appl. No. 11/957,541, 9 pages.
Patent Application, filed Dec. 17, 2010, serial No. PCT/US10/61104, 29 pages.
Drawings, filed Dec. 17, 2010, serial no. PCT/US10/61104, 10 figures, 9 pages.
Scott A. Ager; "IES Fast Speed Gauges", informational presentation, dated Mar. 2, 2009, 38 pages.
IES; "Battery Packing for High Shock", article AN102, received Sep. 1, 2010, 4 pages.
IES; "Accelerometer Wire Termination", article AN106, received Sep. 1, 2010, 4 pages.
John F. Schatz; "PulsFrac Validation: Owen/HTH Surface Block Test", product information, dated 2004, 4 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
ESSCA Group; "Erin Dynamic Flow Analysis Platform", online article, dated 2009, 1 page.
Halliburton; "Fast Gauge Recorder", article 5-110, received Nov. 16, 2010, 2 pages.
Kenji Furui; "A Comprehensive Skin Factor Model for Well Completions Based on Finite Element Simulations", informational paper, dated May 2004, 182 pages.
Halliburton; "Simulation Software for EquiFlow ICD Completions", H07010, dated Sep. 2009, 2 pages.
Search Report with Written Opinion issued Jul. 28, 2011 for International Patent Application No. PCT/US10/61104, 8 pages.
Search Report with Written Opinion issued Jul. 28, 2011 for International Patent Application No. PCT/US10/61107, 9 pages.
Search Report with Written Opinion issued Feb. 9, 2012 for International Patent Application No. PCT/US11/050401, 8 pages.
Search Report with Written Opinion issued Feb. 17, 2012 for International Patent Application No. PCT/US11/050395, 9 pages.
Search Report with Written Opinion issued Feb. 20, 2012 for International Patent Application No. PCT/US11/049882, 9 pages.
Search Report with Written Opinion issued Jul. 28, 2011 for International Patent Application No. PCT/US10/061102, 8 pages.
Office Action issued Jan. 27, 2012 for U.S. Appl. No. 13/210,303, 32 pages.
Office Action issued Feb. 24, 2012 for U.S. Appl. No. 13/304,075, 15 pages.
Office Action issued Apr. 10, 2012 for U.S. Appl. No. 13/325,726, 26 pages.
Office Action issued Jun. 6, 2012 for U.S. Appl. No. 13/325,909, 35 pages.
Specification and Drawings for U.S. Appl. No. 13/493,327, filed Jun. 11, 2012, 30 pages.
International Search Report with Written Opinion issued Nov. 30, 2011 for PCT/US11/036686, 10 pages.
Office Action issued Sep. 6, 2012 for U.S. Appl. No. 13/495,035, 28 pages.
Specification and drawing for U.S. Appl. No. 13/585,846, filed Aug. 25, 2012, 45 pages.
Office Action issued Jun. 11, 2013 for U.S. Appl. No. 13/493,327, 23 pages.
Office Action issued Jun. 20, 2013 for U.S. Appl. No. 13/533,600, 38 pages.
Office Action issued Sep. 13, 2013 for U.S. Appl. No. 13/210,303, 25 pages.
Mexican Office Action issued Sep. 2, 2013 for Mexican Patent Application MX/a/2011/011468, 3 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
Office Action issued Nov. 19, 2012 for U.S. Appl. No. 13/325,909, 43 pages.
Office Action issued Dec. 12, 2012 for U.S. Appl. No. 13/493,327, 75 pages.
Office Action issued Dec. 14, 2012 for U.S. Appl. No. 13/495,035, 19 pages.
Office Action issued Dec. 18, 2012 for U.S. Appl. No. 13/533,600, 48 pages.
Australian Examination Report issued Jan. 3, 2013 for Australian Patent Application No. 2010365400, 3 pages.
Office Action issued Feb. 12, 2013 for U.S. Appl. No. 13/633,077, 31 pages.
Office Action issued Oct. 1, 2012 for U.S. Appl. No. 13/325,726, 20 pages.
Office Action issued Jun. 13, 2012 for U.S. Appl. No. 13/377,148, 38 pages.
Office Action issued Jul. 26, 2012 for U.S. Appl. No. 13/325,726, 52 pages.
Office Action issued Aug. 2, 2012 for U.S. Appl. No. 13/210,303, 35 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D.A. Cuthill et al; "A New Technique for Rapid Estimation of Fracture Closure Stress When Using Propellants", SPE 78171, dated Oct. 20-23, 2002, 6 pages.

(56) References Cited

OTHER PUBLICATIONS

J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "new Effective Stress Law for Predicting Perforation Depth at Downhole Conditions", SPE 111778, dated Feb. 13-15, 2008, 10 pages.
Halliburton; "AutoLatch Release Gun Connector", Special Applications 6-7, received Jan. 19, 2011, 1 page.
Halliburton; "Body Lock Ring", Mechanical Downhole: Technology Transfer, dated Oct. 10, 2001, 4 pages.
Starboard Innovations, LLC; "Downhole Mechanical Shock Absorber", patent and prior art search results, Preliminary Report, dated Jul. 8, 2010, 22 pages.
Carlos Baumann, Harvey Williams, and Schlumberger; "Perforating Wellbore Dynamics and Gunshock in Deepwater TCP Operations", Product informational presentation, IPS-10-018, received May 11, 2011, 28 pages.
Schlumberger; "SXVA Explosively Initiated Vertical Shock Absorber", product paper 06-WT-066, dated 2007, 1 page.
International Search Report with Written Opinion issued Dec. 27, 2011 for PCT Patent Application No. PCT/US11/046955, 8 pages.
Office Action issued Apr. 4, 2013 for U.S. Appl. No. 13/210,303, 29 pages.
Palsay, P.R.; "Stress Analysis of Drillstrings", informational presentation, dated 1994, 14 pages.
Khulief, Y.A.; "Vibration analysis of drillstrings with self-excited stick-slip oscillations", informational paper, dated Jun. 19, 2006, 19 pages.
Office Action issued Jul. 3, 2014 for U.S. Appl. No. 13/210,303, 23 pages.
Mexican Office Action issued Jun. 13, 2014 for MX Patent Application No. MX/a/2013/006899, 2 pages.
English translation of Mexican Office Action issued Jun. 13, 2014 for MX Patent Application No. MX/a/2013/006899, 3 pages.

* cited by examiner

WELL PERFORATING WITH DETERMINATION OF WELL CHARACTERISTICS

CROSS-REFERENCE TO RELATED APPLICATION

This application claims the benefit under 35 USC §119 of the filing date of International Application Serial No. PCT/US10/61107, filed 17 Dec. 2010. The entire disclosure of this prior application is incorporated herein by this reference.

BACKGROUND

The present disclosure relates generally to equipment utilized and operations performed in conjunction with a subterranean well and, in an embodiment described herein, more particularly provides for well perforating combined with determination of well characteristics.

Attempts have been made to record formation pressures and temperatures during and immediately after well perforating. Unfortunately, pressure and temperature readings are typically taken large distances from the perforating event, the large distances tend to dampen the pressure readings and skew the temperature readings, possibly erroneous estimates of hydrostatic pressure gradients are used to compensate for the distances, and differences between perforated intervals cannot be differentiated in the pressure and temperature readings.

Therefore, it will be appreciated that improvements are needed in the art. These improvements can be used, for example, in evaluating characteristics of the perforated formation and/or of individual perforated intervals.

SUMMARY

In carrying out the principles of the present disclosure, improved formation testing methods are provided to the art. One example is described below in which multiple pressure and temperature sensors are distributed along a perforating string. Another example is described below in which the pressure and temperature sensors are positioned close to respective formation intervals.

In one aspect, a formation testing method is provided to the art by the disclosure below. The formation testing method can include interconnecting multiple pressure sensors and multiple perforating guns in a perforating string, the pressure sensors being longitudinally spaced apart along the perforating string; firing the perforating guns; and the pressure sensors measuring pressure variations in a wellbore after firing the perforating guns.

In another aspect, a formation testing method can include interconnecting multiple pressure sensors and multiple perforating guns in a perforating string; firing the perforating guns, thereby perforating a wellbore at multiple formation intervals, each of the pressure sensors being positioned proximate a corresponding one of the formation intervals; and each pressure sensor measuring pressure variations in the wellbore proximate the corresponding interval after firing the perforating guns.

These and other features, advantages and benefits will become apparent to one of ordinary skill in the art upon careful consideration of the detailed description of representative embodiments of the disclosure below and the accompanying drawings, in which similar elements are indicated in the various figures using the same reference numbers.

DETAILED DESCRIPTION

Figure 1:
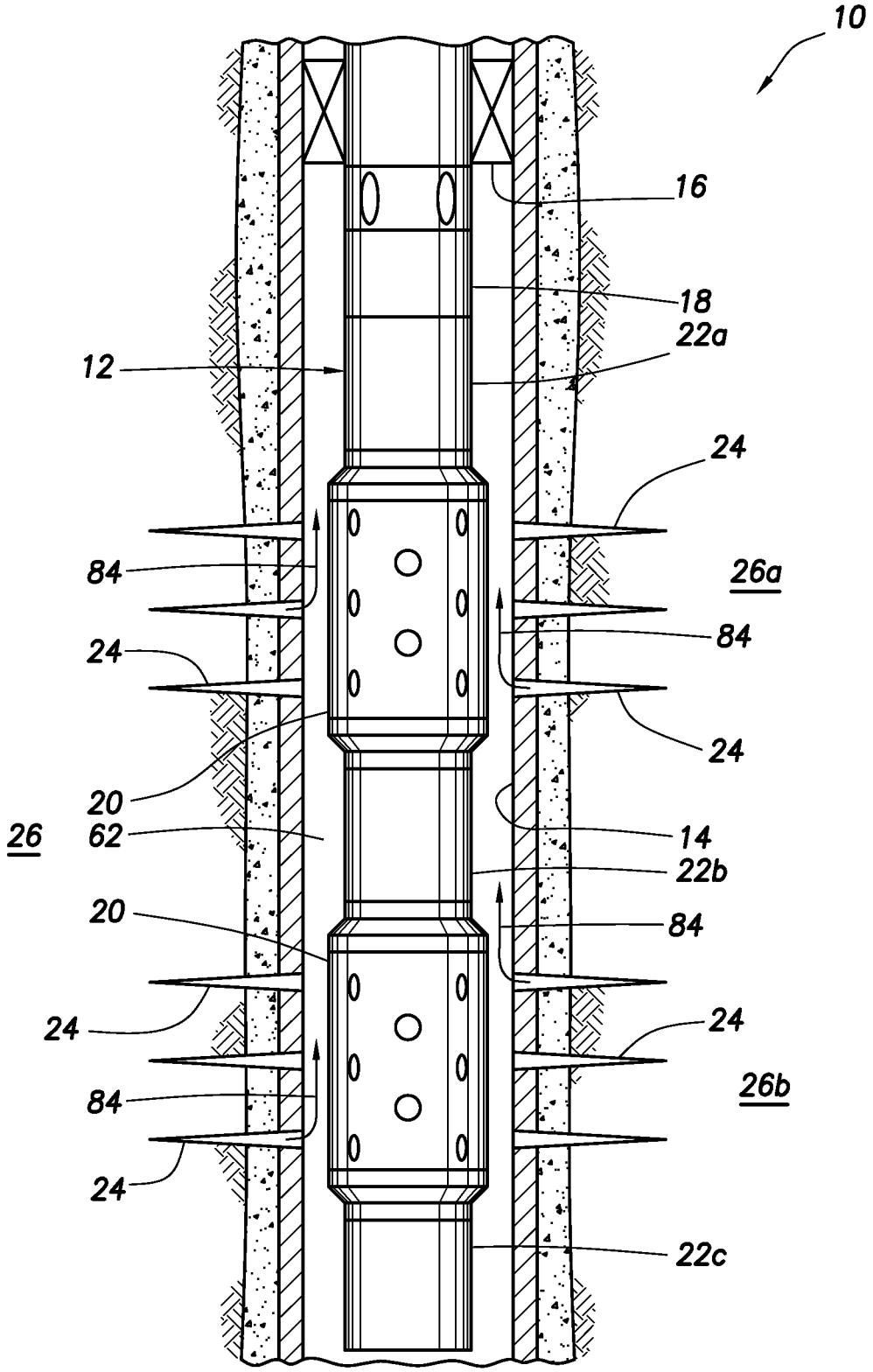
FIG. 1 is a schematic partially cross-sectional view of a well system and associated method which can embody principles of the present disclosure.

Representatively illustrated in FIG. 1 is a well system 10 and associated method which can embody principles of the present disclosure. In the well system 10, a perforating string 12 is installed in a wellbore 14. The depicted perforating string 12 includes a packer 16, a firing head 18, perforating guns 20 and shock sensing tools 22*a-c*.

In other examples, the perforating string 12 may include more or less of these components. For example, well screens and/or gravel packing equipment may be provided, any number (including one) of the perforating guns 20 and shock sensing tools 22*a-c* may be provided, etc. Thus, it should be clearly understood that the well system 10 as depicted in FIG. 1 is merely one example of a wide variety of possible well systems which can embody the principles of this disclosure.

One advantage of interconnecting the shock sensing tools 22*a-c* below the packer 16 and in close proximity to the perforating guns 20 is that more accurate measurements of strain and acceleration at the perforating guns can be obtained. Pressure and temperature sensors of the shock sensing tools 22*a-c* can also sense conditions in the wellbore 14 in close proximity to perforations 24 immediately after the perforations are formed, thereby facilitating more accurate analysis of characteristics of an earth formation 26 penetrated by the perforations.

In the past, a pressure and/or temperature sensor might be positioned some distance above the packer 16 (for example, associated with a tester and/or circulating valve) for measuring pressures and/or temperatures after perforating. However, it is much more desirable for one or more pressure and temperature sensors to be interconnected in the perforating string 12 below the packer 16, as described more fully below.

A shock sensing tool 22*a* interconnected between the packer 16 and the upper perforating gun 20 can record the effects of perforating on the perforating string 12 above the perforating guns. This information can be useful in preventing unsetting or other damage to the packer 16, firing head 18, etc., due to detonation of the perforating guns 20 in future designs.

A shock sensing tool 22*b* interconnected between perforating guns 20 can record the effects of perforating on the perforating guns themselves. This information can be useful in preventing damage to components of the perforating guns 20 in future designs.

A shock sensing tool 22*c* can be connected below the lower perforating gun 20, if desired, to record the effects of perforating at this location. In other examples, the perforating string 12 could be stabbed into a lower completion string, connected to a bridge plug or packer at the lower end of the perforating string, etc., in which case the information recorded by the lower shock sensing tool 22*c* could be useful in preventing damage to these components in future designs.

Viewed as a complete system, the placement of the shock sensing tools 22 longitudinally spaced apart along the perforating string 12 allows acquisition of data at various points in the system, which can be useful in validating a model of the system. Thus, collecting data above, between and below the guns, for example, can help in an understanding of the overall perforating event and its effects on the system as a whole.

The information obtained by the shock sensing tools 22 is not only useful for future designs, but can also be useful for current designs, for example, in post-job analysis, formation testing, etc. The applications for the information obtained by the shock sensing tools 22 are not limited at all to the specific examples described herein.

Referring additionally now to FIGS. 2-5, one example of the shock sensing tool 22 is representatively illustrated. The shock sensing tool 22 may be used for any of the shock sensing tools 22*a-c* of FIG. 1.

Figure 2:
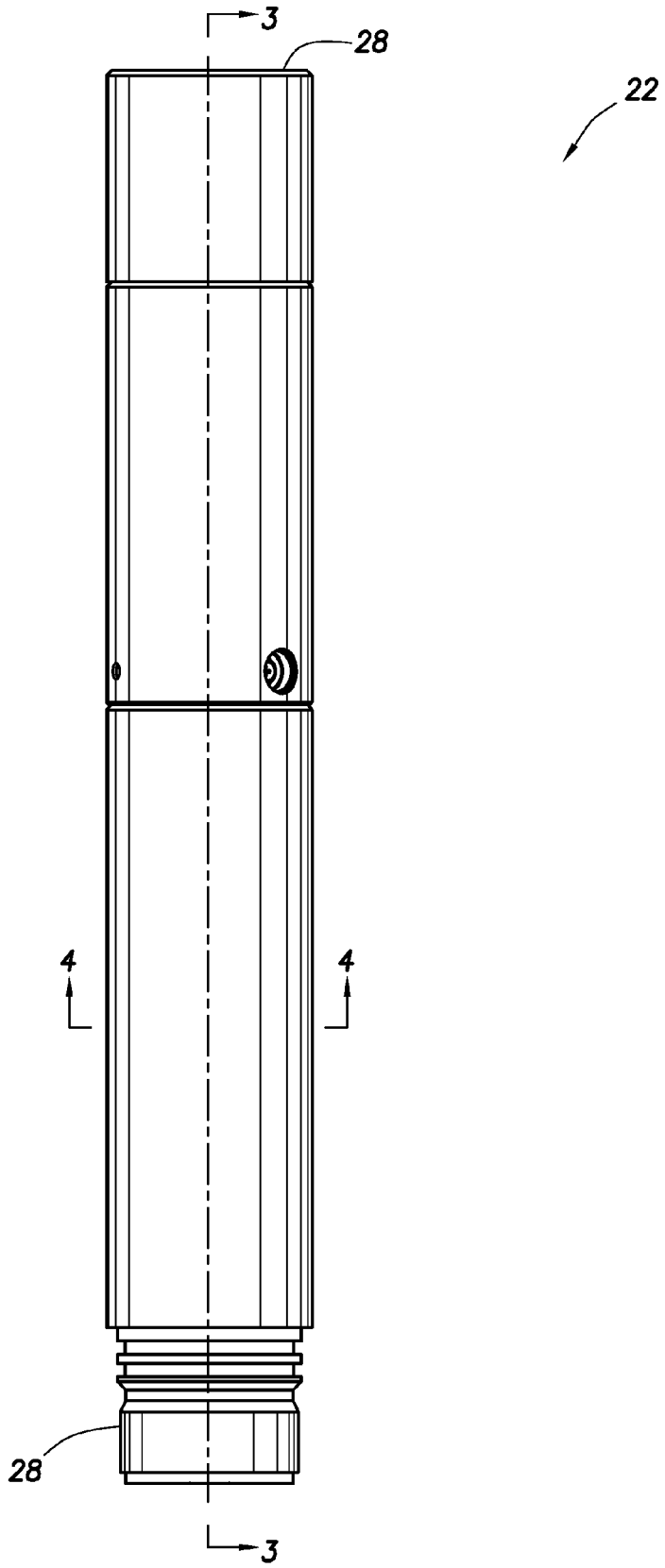
FIGS. 2-5 are schematic views of a shock sensing tool which may be used in the system and method of FIG. 1.

As depicted in FIG. 2, the shock sensing tool 22 is provided with end connectors 28 (such as, perforating gun connectors, etc.) for interconnecting the tool in the perforating string 12 in the well system 10. However, other types of connectors may be used, and the tool 22 may be used in other perforating strings and in other well systems, in keeping with the principles of this disclosure.

Figure 3:
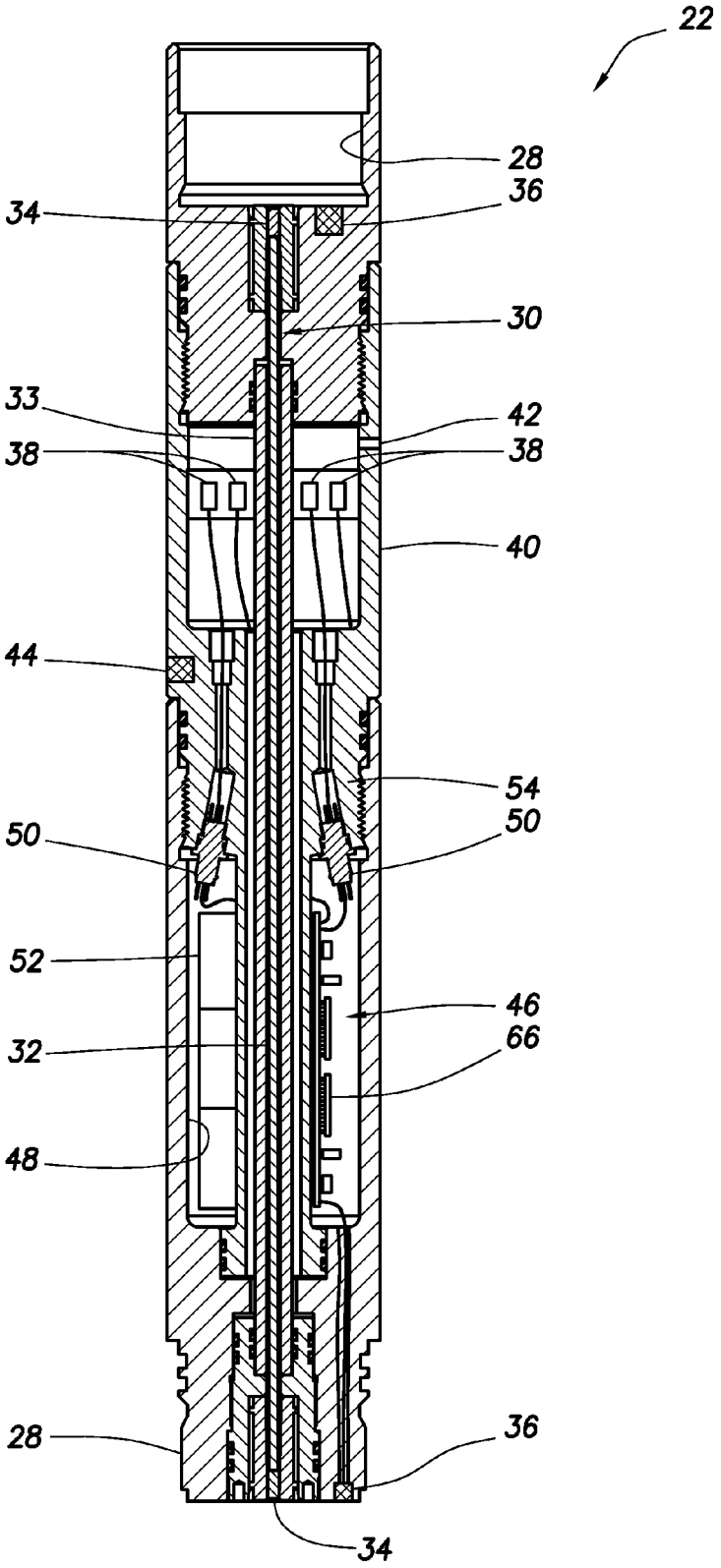

In FIG. 3, a cross-sectional view of the shock sensing tool 22 is representatively illustrated. In this view, it may be seen that the tool 22 includes a variety of sensors, and a detonation train 30 which extends through the interior of the tool.

The detonation train 30 can transfer detonation between perforating guns 20, between a firing head (not shown) and a perforating gun, and/or between any other explosive components in the perforating string 12. In the example of FIGS. 2-5, the detonation train 30 includes a detonating cord 32 and explosive boosters 34, but other components may be used, if desired.

One or more pressure sensors 36 may be used to sense pressure in perforating guns, firing heads, etc., attached to the connectors 28. Such pressure sensors 36 are preferably ruggedized (e.g., to withstand ~20000 g acceleration) and capable of high bandwidth (e.g., >20 kHz). The pressure sensors 36 are preferably capable of sensing up to ~60 ksi (~414 MPa) and withstanding ~175 degrees C. Of course, pressure sensors having other specifications may be used, if desired.

Pressure measurements obtained by the sensors 36 can be useful in modeling the perforating system, optimizing perforating gun 20 design and pre-job planning. In one example, the sensors 36 can measure a pressure increase in the perforating guns 20 when the guns are installed in the wellbore 14. This pressure increase can affect the loads on the guns 20, the guns' response to shock produced by firing the guns, the guns' response to pressure loading, the guns' effect on the wellbore environment after perforating, etc.

Strain sensors 38 are attached to an inner surface of a generally tubular structure 40 interconnected between the connectors 28. The structure 40 is preferably pressure balanced, i.e., with substantially no pressure differential being applied across the structure.

In particular, ports 42 are provided to equalize pressure between an interior and an exterior of the structure 40. By equalizing pressure across the structure 40, the strain sensor 38 measurements are not influenced by any differential pressure across the structure before, during or after detonation of the perforating guns 20.

The strain sensors 38 are preferably resistance wire-type strain gauges, although other types of strain sensors (e.g., piezoelectric, piezoresistive, fiber optic, etc.) may be used, if desired. In this example, the strain sensors 38 are mounted to a strip (such as a KAPTON™ strip) for precise alignment, and then are adhered to the interior of the structure 40.

Preferably, four full Wheatstone bridges are used, with opposing 0 and 90 degree oriented strain sensors being used for sensing axial and bending strain, and +/−45 degree gauges being used for sensing torsional strain.

The strain sensors 38 can be made of a material (such as a KARMA™ alloy) which provides thermal compensation, and allows for operation up to ~150 degrees C. Of course, any type or number of strain sensors may be used in keeping with the principles of this disclosure.

The strain sensors 38 are preferably used in a manner similar to that of a load cell or load sensor. A goal is to have all of the loads in the perforating string 12 passing through the structure 40 which is instrumented with the sensors 38.

Having the structure 40 fluid pressure balanced enables the loads (e.g., axial, bending and torsional) to be measured by the sensors 38, without influence of a pressure differential across the structure. In addition, the detonating cord 32 is housed in a tube 33 which is not rigidly secured at one or both of its ends, so that it does not share loads with, or impart any loading to, the structure 40.

A temperature sensor 44 (such as a thermistor, thermocouple, etc.) can be used to monitor temperature external to the tool, such as temperature in the wellbore 14. Temperature measurements can be useful in evaluating characteristics of the formation 26, and any fluid produced from the formation, immediately following detonation of the perforating guns 20. Temperature measurements can be useful in detecting flow behind casing, in detecting cross-flow between intervals 26*a, b*, in detecting temperature variations from the geothermal gradient, in detecting temperature variations between the intervals 26*a,b*, etc. Preferably, the temperature sensor 44 is capable of accurate high resolution measurements of temperatures up to ~170 degrees C.

Another temperature sensor (not shown) may be included with an electronics package 46 positioned in an isolated chamber 48 of the tool 22. In this manner, temperature within the tool 22 can be monitored, e.g., for diagnostic purposes or for thermal compensation of other sensors (for example, to correct for errors in sensor performance related to temperature change). Such a temperature sensor in the chamber 48 would not necessarily need the high resolution, responsiveness or ability to track changes in temperature quickly in wellbore fluid of the other temperature sensor 44.

The electronics package 46 is connected to at least the strain sensors 38 via pressure isolating feed-throughs or bulkhead connectors 50. Similar connectors may also be used for connecting other sensors to the electronics package 46. Batteries 52 and/or another power source may be used to provide electrical power to the electronics package 46.

The electronics package 46 and batteries 52 are preferably ruggedized and shock mounted in a manner enabling them to withstand shock loads with up to −10000 g acceleration. For example, the electronics package 46 and batteries 52 could be potted after assembly, etc.

Figure 4:
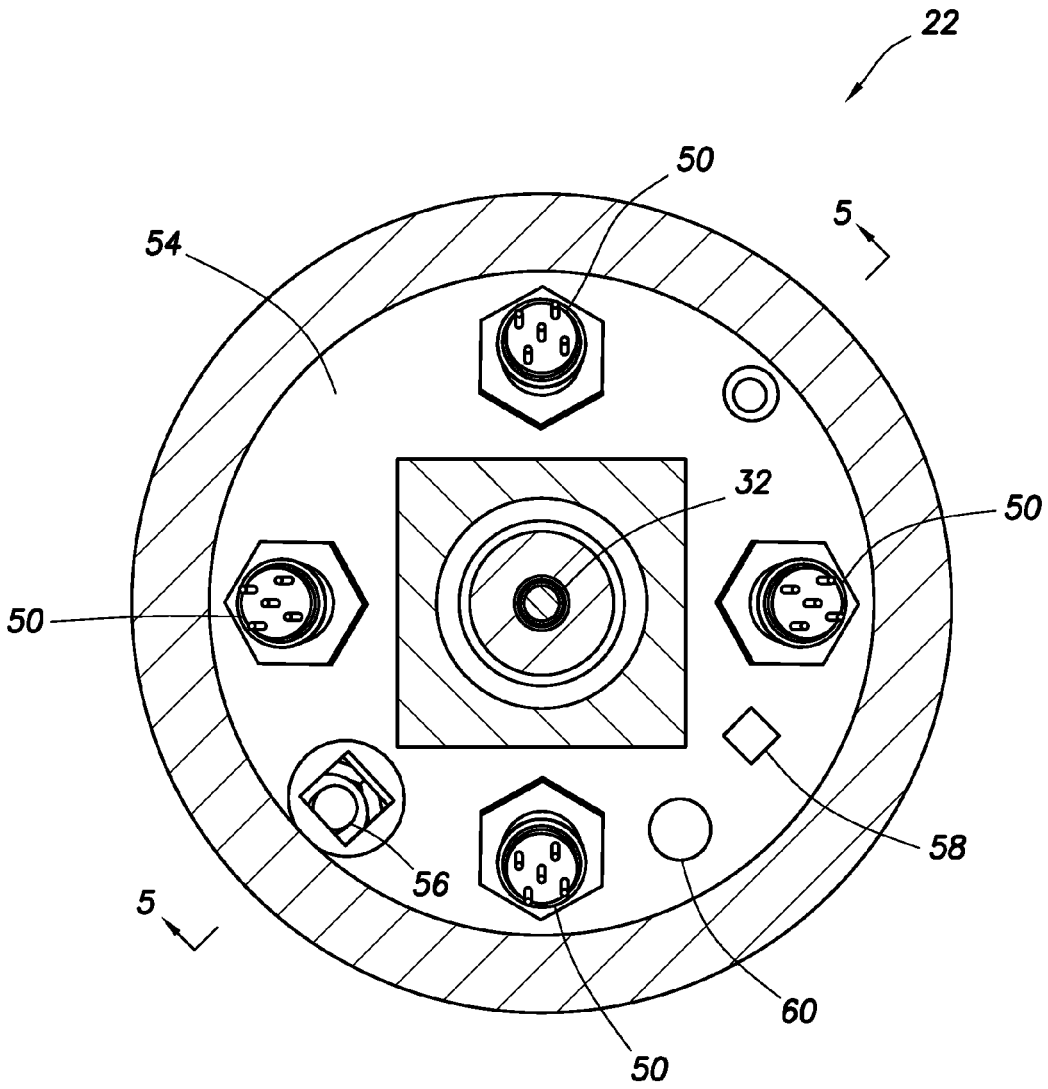

In FIG. 4 it may be seen that four of the connectors 50 are installed in a bulkhead 54 at one end of the structure 40. In addition, a pressure sensor 56, a temperature sensor 58 and an accelerometer 60 are preferably mounted to the bulkhead 54.

The pressure sensor 56 is used to monitor pressure external to the tool 22, for example, in an annulus 62 formed radially between the perforating string 12 and the wellbore 14 (see FIG. 1). The pressure sensor 56 may be similar to the pressure sensors 36 described above. A suitable pressure transducer is the Kulite model HKM-15-500.

The temperature sensor 58 may be used for monitoring temperature within the tool 22. This temperature sensor 58 may be used in place of, or in addition to, the temperature sensor described above as being included with the electronics package 46.

The accelerometer 60 is preferably a piezoresistive type accelerometer, although other types of accelerometers may be used, if desired. Suitable accelerometers are available from Endevco and PCB (such as the PCB 3501A series, which is available in single axis or triaxial packages, capable of sensing up to ~60000 g acceleration).

Figure 5:
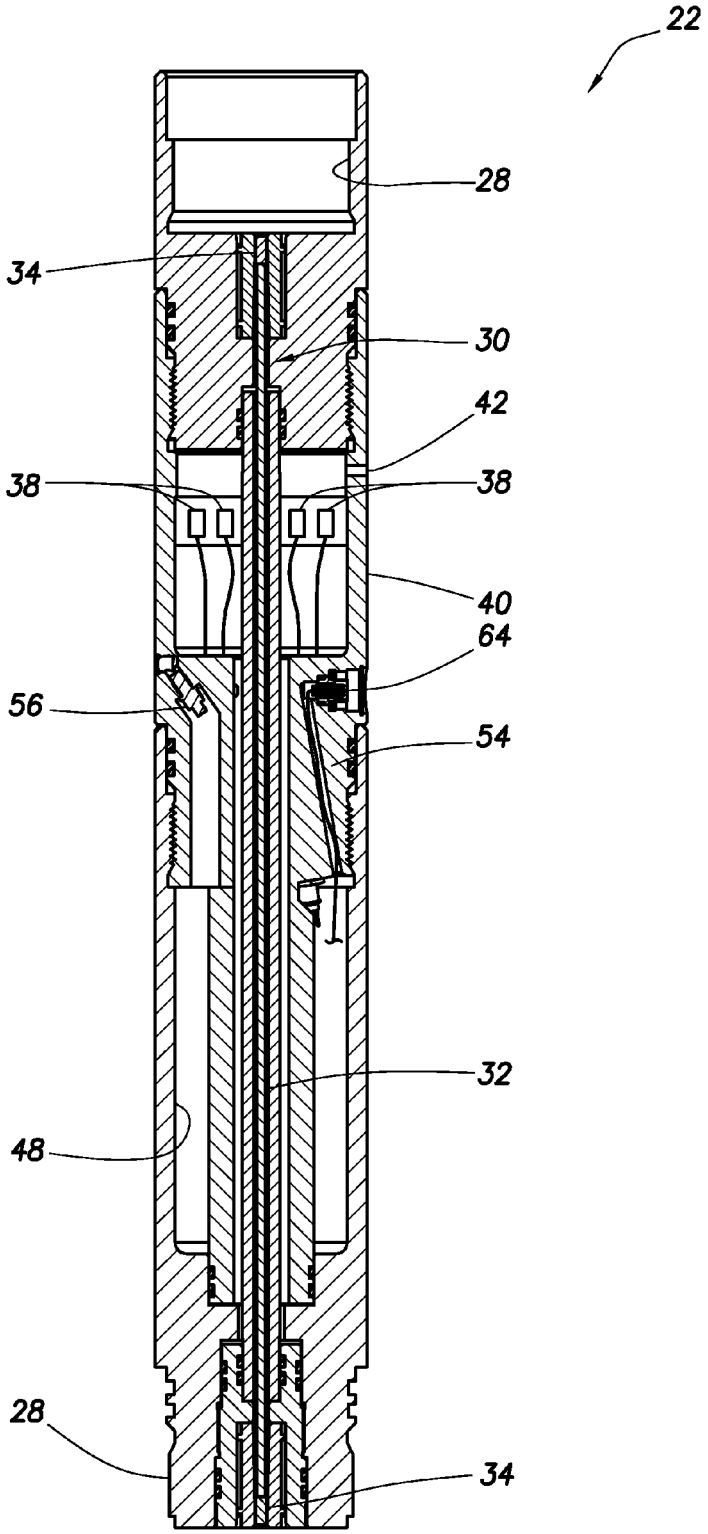

In FIG. 5, another cross-sectional view of the tool 22 is representatively illustrated. In this view, the manner in which the pressure transducer 56 is ported to the exterior of the tool 22 can be clearly seen. Preferably, the pressure transducer 56 is close to an outer surface of the tool, so that distortion of measured pressure resulting from transmission of pressure waves through a long narrow passage is prevented.

Also visible in FIG. 5 is a side port connector 64 which can be used for communication with the electronics package 46 after assembly. For example, a computer can be connected to the connector 64 for powering the electronics package 46, extracting recorded sensor measurements from the electronics package, programming the electronics package to respond to a particular signal or to "wake up" after a selected time, otherwise communicating with or exchanging data with the electronics package, etc.

Note that it can be many hours or even days between assembly of the tool 22 and detonation of the perforating guns 20. In order to preserve battery power, the electronics package 46 is preferably programmed to "sleep" (i.e., maintain a low power usage state), until a particular signal is received, or until a particular time period has elapsed.

The signal which "wakes" the electronics package 46 could be any type of pressure, temperature, acoustic, electromagnetic or other signal which can be detected by one or more of the sensors 36, 38, 44, 56, 58, 60. For example, the pressure sensor 56 could detect when a certain pressure level has been achieved or applied external to the tool 22, or when a particular series of pressure levels has been applied, etc. In response to the signal, the electronics package 46 can be activated to a higher measurement recording frequency, measurements from additional sensors can be recorded, etc.

As another example, the temperature sensor 58 could sense an elevated temperature resulting from installation of the tool 22 in the wellbore 14. In response to this detection of elevated temperature, the electronics package 46 could "wake" to record measurements from more sensors and/or higher frequency sensor measurements.

As yet another example, the strain sensors 38 could detect a predetermined pattern of manipulations of the perforating string 12 (such as particular manipulations used to set the packer 16). In response to this detection of pipe manipulations, the electronics package 46 could "wake" to record measurements from more sensors and/or higher frequency sensor measurements.

The electronics package 46 depicted in FIG. 3 preferably includes a non-volatile memory 66 so that, even if electrical power is no longer available (e.g., the batteries 52 are discharged), the previously recorded sensor measurements can still be downloaded when the tool 22 is later retrieved from the well. The non-volatile memory 66 may be any type of memory which retains stored information when powered off. This memory 66 could be electrically erasable programmable read only memory, flash memory, or any other type of non-volatile memory. The electronics package 46 is preferably able to collect and store data in the memory 66 at >100 kHz sampling rate.

Figure 6:
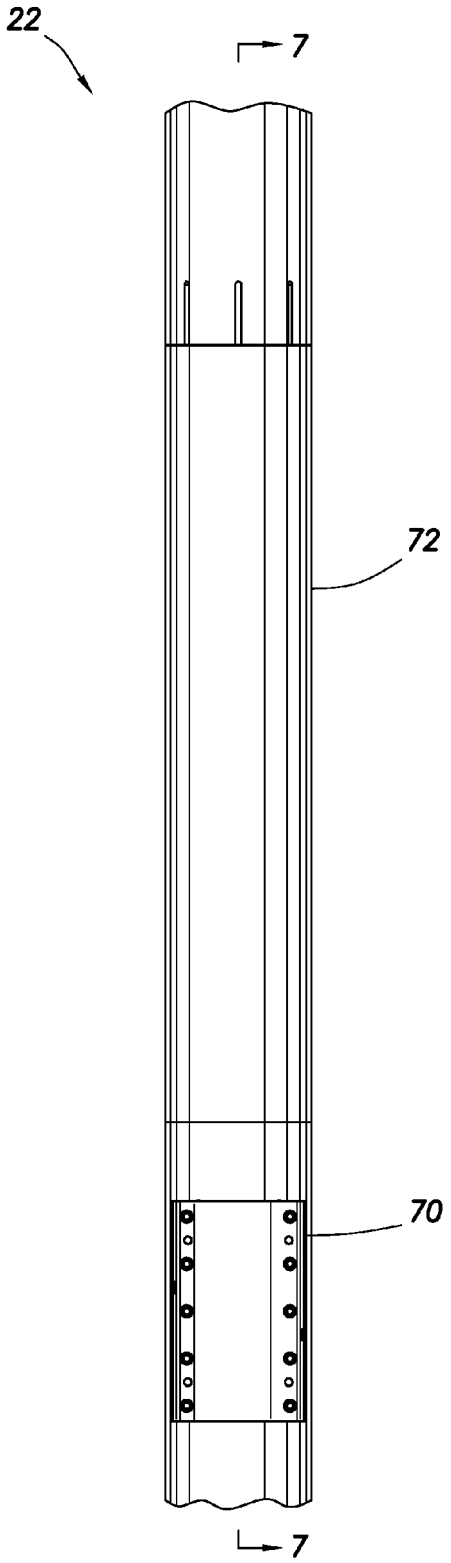
FIGS. 6-8 are schematic views of another configuration of the shock sensing tool.
Figure 7:
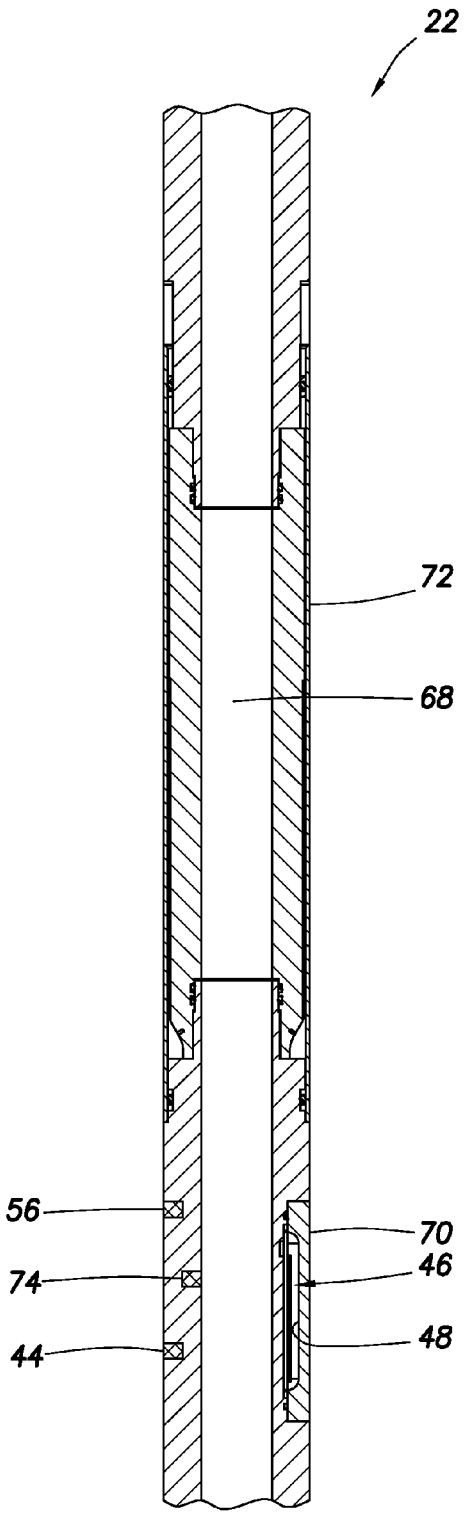
Figure 8:
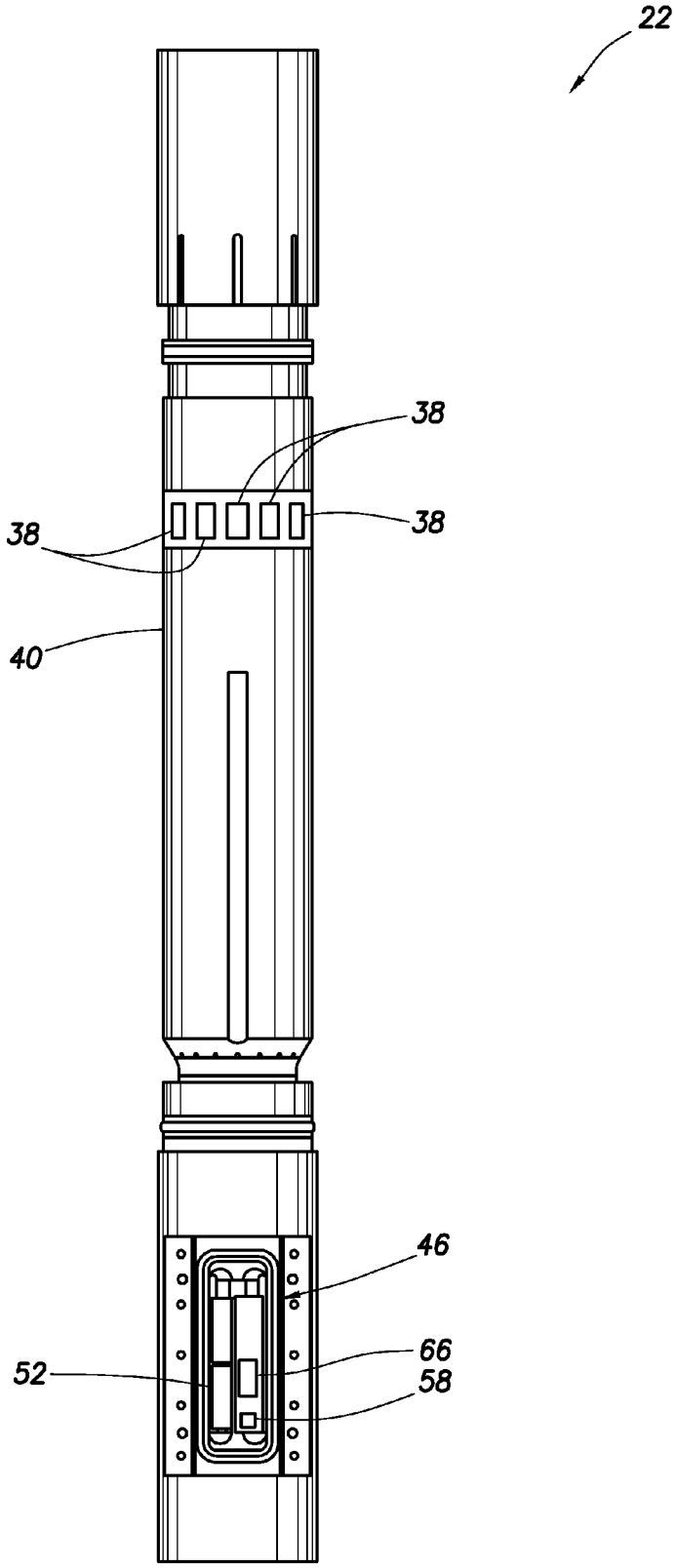

Referring additionally now to FIGS. 6-8, another configuration of the shock sensing tool 22 is representatively illustrated. In this configuration, a flow passage 68 (see FIG. 7) extends longitudinally through the tool 22. Thus, the tool 22 may be especially useful for interconnection between the packer 16 and the upper perforating gun 20, although the tool 22 could be used in other positions and in other well systems in keeping with the principles of this disclosure.

In FIG. 6 it may be seen that a removable cover 70 is used to house the electronics package 46, batteries 52, etc. In FIG. 8, the cover 70 is removed, and it may be seen that the temperature sensor 58 is included with the electronics package 46 in this example. The accelerometer 60 could also be part of the electronics package 46, or could otherwise be located in the chamber 48 under the cover 70.

A relatively thin protective sleeve 72 is used to prevent damage to the strain sensors 38, which are attached to an exterior of the structure 40 (see FIG. 8, in which the sleeve is removed, so that the strain sensors are visible). Although in this example the structure 40 is not pressure balanced, another pressure sensor 74 (see FIG. 7) can be used to monitor pressure in the passage 68, so that any contribution of the pressure differential across the structure 40 to the strain sensed by the strain sensors 38 can be readily determined (e.g., the effective strain due to the pressure differential across the structure 40 is subtracted from the measured strain, to yield the strain due to structural loading alone).

Note that there is preferably no pressure differential across the sleeve 72, and a suitable substance (such as silicone oil, etc.) is preferably used to fill the annular space between the sleeve and the structure 40. The sleeve 72 is not rigidly secured at one or both of its ends, so that it does not share loads with, or impart loads to, the structure 40.

Any of the sensors described above for use with the tool 22 configuration of FIGS. 2-5 may also be used with the tool configuration of FIGS. 6-8.

In general, it is preferable for the structure 40 (in which loading is measured by the strain sensors 38) to experience loading due only to the perforating event, as in the configuration of FIGS. 2-5. However, other configurations are possible in which this condition can be satisfied. For example, a pair of pressure isolating sleeves could be used, one external to, and the other internal to, the load bearing structure 40 of the FIGS. 6-8 configuration. The sleeves could be strong enough to withstand the pressure in the well, and could be sealed with o-rings or other seals on both ends. The sleeves could be structurally connected to the tool at no more than one end, so that a secondary load path around the strain sensors 38 is prevented.

Although the perforating string 12 described above is of the type used in tubing-conveyed perforating, it should be clearly understood that the principles of this disclosure are not limited to tubing-conveyed perforating. Other types of perforating (such as, perforating via coiled tubing, wireline or slickline, etc.) may incorporate the principles described herein. Note that the packer 16 is not necessarily a part of the perforating string 12.

Note that it is not necessary for the tool 22 to be used for housing the pressure sensor 56 or any of the other sensors described above. The formation testing methods described herein could be performed with other tools, other sensors, etc., in keeping with the principles of this disclosure. However, the tool 22 described above is especially adapted for withstanding the shock produced by firing perforating guns.

By positioning the pressure sensors 56 of the tools 22*a-c* in close proximity to each of multiple formation intervals 26*a,b* perforated by the guns 20, each pressure sensor can measure pressure variations in the wellbore 14 proximate the respective intervals, so that the characteristics of the individual intervals can be more readily determined.

Shut-in and drawdown tests can be performed after perforating, with the sensors 56 being used to measure pressure in close proximity to the intervals 26*a,b*. These pressure measurements (and other sensor measurements, e.g., temperature measurements) can be used to determine characteristics (such as permeability, porosity, fluid type, etc.) of the respective individual intervals 26*a,b*.

A shut-in test can be performed, for example, by closing a valve (not shown) to shut off flow of formation fluid 84. A suitable valve for use in the shut-in test is the OMNI™ valve marketed by Halliburton Energy Services, Inc. of Houston, Tex. USA, although other valves may be used within the scope of this disclosure. The rate at which pressure builds up after shutting off flow can be used to determine characteristics of the formation 26 and its respective intervals 26*a,b*.

By longitudinally distributing the temperature sensors 44 along the perforating string 12, temperature variations in the wellbore 14 proximate the intervals 26*a,b* perforated by the guns 20 can be obtained, so that the characteristics of the individual intervals can be more readily determined. Furthermore, before perforating, the temperature measurements made with the sensors 44 can be used to detect fluid flow outside of casing, to detect any temperature variations from the geothermal gradient, and for other purposes.

After perforating, such as during the shut-in tests discussed above, the temperature sensors 44 will give much more accurate temperature measurements proximate the individual intervals 26*a,b* than could be obtained using a remotely located temperature sensor, thereby enabling more accurate determination of the characteristics of the formation 26 and the individual intervals 26*a,b*. Temperature measurements can also be used, for example, to detect an interval that is warmer or cooler than the others, to detect cross-flow between intervals, etc.

In addition, injection tests can be performed after perforating. An injection test can include flowing fluid from the wellbore 14 into the formation 26 and its individual intervals 26*a,b*. The temperature sensors 44 can detect temperature variations due to the fluid flowing along the wellbore 14, and from the wellbore 14 into the individual intervals 26*a,b*, so that the flow rate and volume of fluid which flows into the individual intervals can be conveniently determined (generally, a reduction in temperature will indicate injection fluid flow). This information can be useful, for example, for planning subsequent stimulation operations (such as fracturing, acidizing, conformance treatments, etc.).

Figure 9:
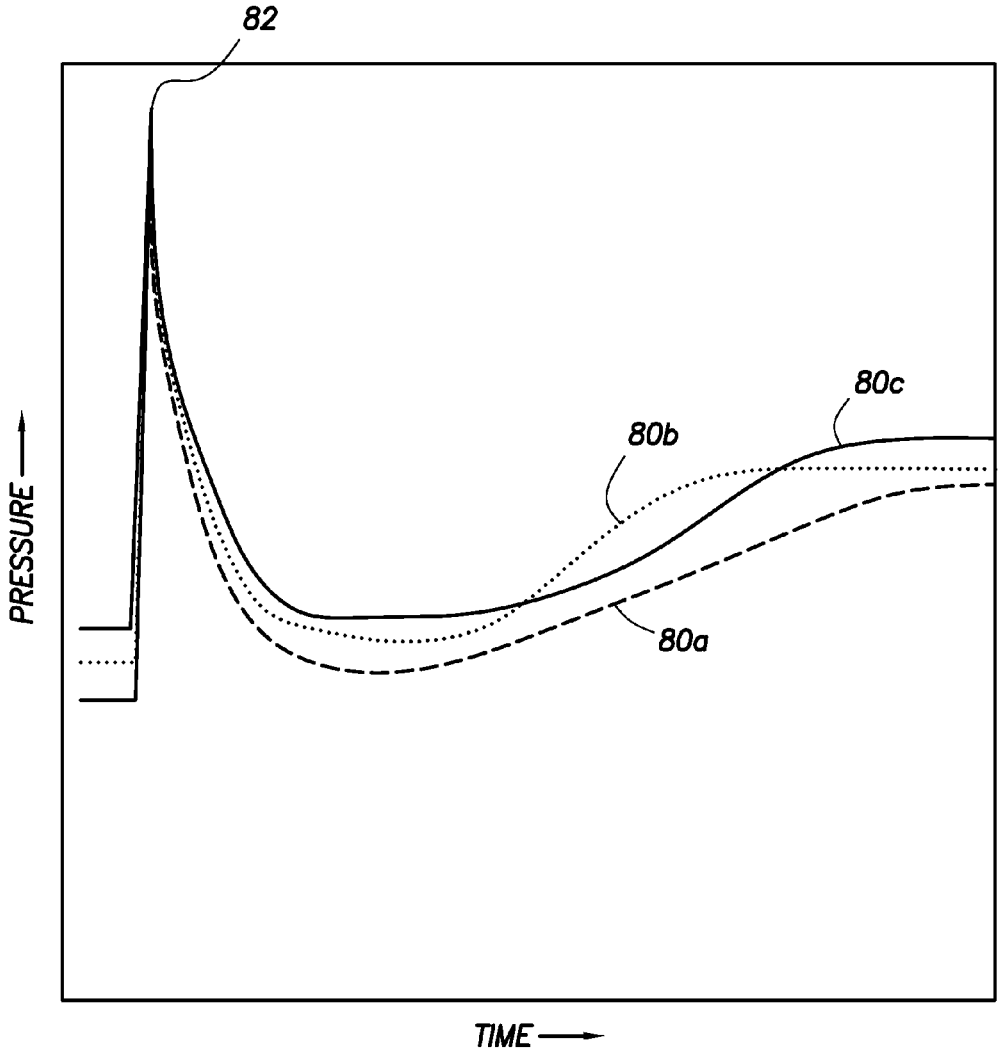
FIG. 9 is a schematic graph of pressure variations measured by pressure sensors of respective multiple shock sensing tools.

Referring additionally now to FIG. 9, a schematic graph of pressure measurements 80*a-c* recorded by the respective tools 22*a-c* is representatively illustrated. Note that the pressure measurements 80*a-c* do not have the same shape, indicating that the individual intervals 26*a,b* respond differently to the stimulus applied when the perforating guns 20 are fired. These different pressure responses can be used to evaluate the different characteristics of the individual intervals 26*a,b*.

For example, all of the pressure sensors 56 of the tools 22*a-c* measure about the same pressure 82 when the guns 20 are fired. However, soon after firing the guns 20, pressure in the wellbore 14 decreases due to dissipation of the pressure generated by the guns.

In some cases, it may be possible to see where a fracture (opened up by the perforating event) closes after the guns 20 are fired. For example, a positive (less negative) change in the slope of the pressure measurements can indicate a fracture closing (due to less bleed off into the formation 26 when the fracture closes).

Pressure in the wellbore 14 then gradually increases due to the communication between the intervals 26*a,b* and the wellbore provided by the perforations 24. Eventually, the pressure in the wellbore 14 at each pressure sensor 56 may stabilize at the pore pressure in the formation 26.

The values and slopes of each of the pressure measurements 80*a-c* can provide information on the characteristics of the individual intervals 26*a,b*. For example, note that the pressure measurements 80*b* have a greater slope following the pressure decrease in FIG. 9, as compared to the slope of the pressure measurements 80*a* & *c*. This greater slope can indicate greater permeability in the adjacent interval 26*b*, as compared to the other interval 26*a*, due to formation fluid 84 (see FIG. 1) more readily entering the wellbore 14 via the perforations 24. Since the slope of the pressure measurements 80*a* following the pressure decrease in FIG. 9 is less than that of the other pressure measurements 80*b,c* it may be determined that the interval 26*a* has less permeability as compared to the other interval 26*b*.

Of course, other characteristics of the intervals 26*a,b* can be individually determined using the pressure measurements 80*a-c* depicted in FIG. 9. These characteristics may include porosity, pore pressure, and/or any other characteristics. In addition, sensor measurements other than, or in addition to, pressure measurements may be used in determining these characteristics (for example, temperature measurements taken by the sensors 44, 58 could be useful in this regard).

Note that, although the pressure sensors 56 of the tools 22*a-c* are not necessarily positioned directly opposite the perforations 24 when the guns 20 are fired, the pressure sensors preferably are closely proximate the perforations (for example, straddling the perforations, adjacent the perforations, etc.), so that the pressure sensors can individually measure pressures along the wellbore 14, enabling differentiation between the responses of the intervals 26*a,b* to the perforating event.

The tools 22*a-c* and their associated pressure, temperature, and other sensors can be used to characterize each of multiple intervals 26*a,b* along a wellbore 14. The measurements obtained by the sensors can be used to identify the characteristics of multiple intervals individually.

The sensors can be used to measure various parameters (pressure, temperature, etc.) at each individual interval before, during and after the perforating event. For example, the sensors can measure an underbalanced, balanced or overbalanced condition prior to perforating. The sensors can measure pressure increases due to, for example, firing the perforating guns, applying a stimulation treatment (e.g., by igniting a propellant in the wellbore, etc.), etc. As another example, the sensors can measure pressure decreases due to, for example, dissipation of perforating or stimulation applied pressure, surging the perforations (e.g., by opening an empty surge chamber in the wellbore, etc.), etc. The sensors can measure parameters (pressure, temperature, etc.) at each individual interval during flow and shut-in tests after perforating.

Although only two of the intervals 26*a,b*, two of the perforating guns 20 and three of the tools 22*a-c* are depicted in FIG. 1, it should be understood that any number of these elements could exist in systems and methods incorporating the principles of this disclosure. It is not necessary for there to be a one-to-one correspondence between perforating guns and intervals, for each perforating gun to be straddled by two sensing tools, etc. Thus, it will be appreciated that the principles of this disclosure are not limited at all to the details of the system 10 and method depicted in FIG. 1 and described above.

It may now be fully appreciated that the above disclosure provides several advancements to the art. In the example of a formation testing method described above, pressure measurements are taken in close proximity to formation intervals 26*a,b*, instead of from a large distance. This allows for more accurate determination of characteristics of the formation 26, and in some examples, allows for differentiation between characteristics of the individual intervals 26*a,b*.

In particular, the above disclosure provides to the art a formation testing method. The method can include interconnecting multiple pressure sensors 56 and multiple perforating guns 20 in a perforating string 12, the pressure sensors 56 being longitudinally spaced apart along the perforating string 12; firing the perforating guns 20; and the pressure sensors 56 measuring pressure variations in a wellbore 14 after firing the perforating guns 20.

The method can include multiple temperature sensors 44 longitudinally spaced apart along the perforating string 12. The temperature sensors 44 may measure temperature variations in the wellbore 14 prior to and/or after firing the perforating guns 20.

The pressure sensors 56 may measure a pressure increase in the wellbore 14, with the pressure increase resulting from firing the perforating guns 20.

The pressure sensors 56 may measure a pressure decrease in the wellbore 14 subsequent to firing the perforating guns 20. The pressure sensors 56 can measure a pressure increase in the wellbore 14 when formation fluid 84 enters the wellbore 14.

At least one of the perforating guns 20 can be positioned between two of the pressure sensors 56. At least one of the pressure sensors 56 can be interconnected between two of the perforating guns 20.

Firing the perforating guns 20 may include perforating the wellbore 14 at multiple formation intervals 26*a,b*. Each of the pressure sensors 56 can be positioned proximate a corresponding one of the formation intervals 26*a,b*. Each of the formation intervals 26*a,b* can be positioned between two of the pressure sensors 56.

The pressure sensors 56 may be included in respective shock sensing tools 22*a-c*. A detonation train 30 can extend through the shock sensing tools 22*a-c*.

The pressure sensors 56 may sense pressure in an annulus 62 formed radially between the perforating string 12 and the wellbore 14.

Increased recording of pressure measurements can be made in response to sensing a predetermined event.

The perforating guns 20 are preferably positioned on a same side of a packer 16 as the pressure sensors 56.

Also described by the above disclosure is a formation testing method which can include interconnecting multiple pressure sensors 56 and multiple perforating guns 20 in a perforating string 12; firing the perforating guns 20, thereby perforating a wellbore 14 at multiple formation intervals 26*a, b*, each of the pressure sensors 56 being positioned proximate a corresponding one of the formation intervals 26*a,b*; and each pressure sensor 56 measuring pressure variations in the wellbore 14 proximate the corresponding one of the intervals 26*a,b* after firing the perforating guns 20.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of determining characteristics of a subterranean well, the method comprising:

forming a perforating string by interconnecting multiple perforating guns and multiple non-perforating tubular string sections, wherein each of the multiple non-perforating tubular string sections includes a pressure sensor and an accelerometer;

positioning the perforating string in a wellbore;

firing the perforating guns; and collecting data above, between and below the perforating guns via the non-perforating tubular string sections before, during and after the firing.

2. The method of claim 1, further comprising multiple temperature sensors longitudinally spaced apart along the perforating string, and wherein the temperature sensors measure temperature variations in the wellbore prior to the firing the perforating guns.

3. The method of claim 1, further comprising multiple temperature sensors longitudinally spaced apart along the perforating string, and wherein the temperature sensors measure temperature variations in the wellbore after the firing the perforating guns.

4. The method of claim 1, wherein at least one of the pressure sensors measures a pressure increase in the wellbore, the pressure increase resulting from the firing the perforating guns.

5. The method of claim 1, wherein at least one of the pressure sensors measures a pressure decrease in the wellbore subsequent to the firing the perforating guns.

6. The method of claim 5, wherein at least one of the pressure sensors measures a pressure increase in the wellbore when formation fluid enters the wellbore.

7. The method of claim 1, wherein at least one of the perforating guns is interconnected between two of the non-perforating tubular string sections.

8. The method of claim 1, wherein at least one of the non-perforating tubular sections is interconnected between two of the perforating guns.

9. The method of claim 1, wherein firing the perforating guns comprises perforating the wellbore at multiple formation intervals, and wherein at least one of the non-perforating tubular string sections is positioned proximate a corresponding one of the formation intervals.

10. The method of claim 9, wherein each of the formation intervals is positioned between two of the non-perforating tubular string sections.

11. The method of claim 1, wherein a detonation train extends through the at least one of the non-perforating tubular string sections.

12. The method of claim 1, wherein the pressure sensors sense pressure in an annulus formed radially between the perforating string and the wellbore.

13. The method of claim 1, wherein increased recording of pressure measurements is initiated in response to sensing a predetermined event.

14. The method of claim 1, wherein the non-perforating tubular string sections are positioned on a same side of a firing head as the perforating guns.

15. A formation testing method, comprising:

forming a perforating string by interconnecting multiple perforating guns and multiple non-perforating tubular string sections, wherein at least one non-perforating tubular string section is positioned below the perforating guns in the perforating string, wherein at least one non-perforating tubular string section is positioned between each adjacent pair of perforating guns in the perforating string, wherein at least one non-perforating tubular string section is positioned above the perforating guns in the perforating string, and wherein each of the multiple non-perforating tubular string sections includes a pressure sensor and an accelerometer;

positioning the perforating string in a wellbore;

firing the perforating guns, thereby forming multiple longitudinally spaced apart perforations in the wellbore corresponding to each of the multiple perforating guns; and measuring pressure and acceleration above, between and below the perforations via the non-perforating tubular string sections during and after the firing.

16. The method of claim 15, further comprising multiple temperature sensors longitudinally spaced apart along the perforating string, and wherein the temperature sensors measure temperature variations in the wellbore prior to the firing the perforating guns.

17. The method of claim 15, further comprising multiple temperature sensors longitudinally spaced apart along the perforating string, and wherein the temperature sensors measure temperature variations in the wellbore after the firing the perforating guns.

18. The method of claim 15, wherein at least one of the pressure sensors measures a pressure increase in the wellbore, the pressure increase resulting from the firing the perforating guns.

19. The method of claim 15, wherein at least one of the pressure sensors measures a pressure decrease in the wellbore subsequent to firing the perforating guns.

20. The method of claim 19, wherein at least one of the pressure sensors measures a pressure increase in the wellbore when formation fluid enters the wellbore.

21. The method of claim 15, wherein an increased recording of pressure and acceleration measurements is initiated in response to sensing a predetermined event.

22. The method of claim 15, wherein a detonation train extends through at least one of the non-perforating tubular string sections.

23. The method of claim 15, wherein the pressure sensors sense pressure in an annulus formed radially between the perforating string and the wellbore.

24. The method of claim 15, wherein the non-perforating tubular string sections are positioned on a same side of a firing head as the perforating guns.

* * * * *

UNITED STATES PATENT AND TRADEMARK OFFICE

CERTIFICATE OF CORRECTION

PATENT NO. : 8,899,320 B2
APPLICATION NO. : 13/314853
DATED : December 2, 2014
INVENTOR(S) : Le It is certified that error appears in the above-identified patent and that said Letters Patent is hereby corrected as shown below:

On the title page, Item [30], Foreign Application Priority Data, delete "PCT/US2010/006110" and insert in place thereof -- PCT/US2010/061107 --.

Signed and Sealed this
Seventeenth Day of March, 2015

Michelle K. Lee

Michelle K. Lee
*Director of the United States Patent and Trademark Office*